United States Patent [19]

Hoekstra

[11] 4,366,765

[45] Jan. 4, 1983

[54] COMBINATION SINGLE THREAD CHAIN AND LOCK STITCH

[75] Inventor: Joop F. Hoekstra, Medfield, Mass.

[73] Assignee: The Reece Corporation, Waltham, Mass.

[21] Appl. No.: 177,903

[22] Filed: Aug. 14, 1980

[51] Int. Cl.[3] ..... D05B 93/00

[52] U.S. Cl. ..... 112/429; 112/262.1; 112/430; 112/438

[58] Field of Search ..... 112/197, 198, 262.1, 112/430, 438, 429

[56] References Cited

U.S. PATENT DOCUMENTS

| | | | |
|---|---|---|---|
| 10,597 | 3/1854 | Johnson | 112/197 |
| 27,999 | 4/1860 | McCurdy | 112/438 |
| 237,966 | 2/1881 | Elliott | 112/262.1 |
| 757,374 | 4/1904 | Webster | 112/438 |
| 1,559,840 | 11/1925 | Baker | 112/262.1 |
| 1,626,337 | 4/1927 | Haenicke | 112/408 X |
| 2,497,230 | 2/1950 | Monroe | 112/438 |
| 3,224,399 | 12/1965 | Lightner et al. | 112/262.1 |
| 3,320,911 | 5/1967 | Ketterer | 112/262.1 X |

FOREIGN PATENT DOCUMENTS

| | | | |
|---|---|---|---|
| 11597 | 8/1854 | France | 112/197 |
| 2051932 | 3/1971 | France | 112/262.1 |

*Primary Examiner*—Wm. Carter Reynolds
*Attorney, Agent, or Firm*—Garrett J. Cullen, Jr.

[57] ABSTRACT

The invention concerns a stitch formation and method of making it which consists of alternate chain and lock stitches formed from a single continuous thread. On the first penetration of the needle, the thread is divided into two portions, one on each side of the work piece and then subsequent penetration of the needle forms the alternate chain and lock stitches with the drawn off thread portion passing through the alternate loops to form the lock stitch.

7 Claims, 2 Drawing Figures

COMBINATION SINGLE THREAD CHAIN AND LOCK STITCH

BACKGROUND OF THE INVENTION

Figure 1:
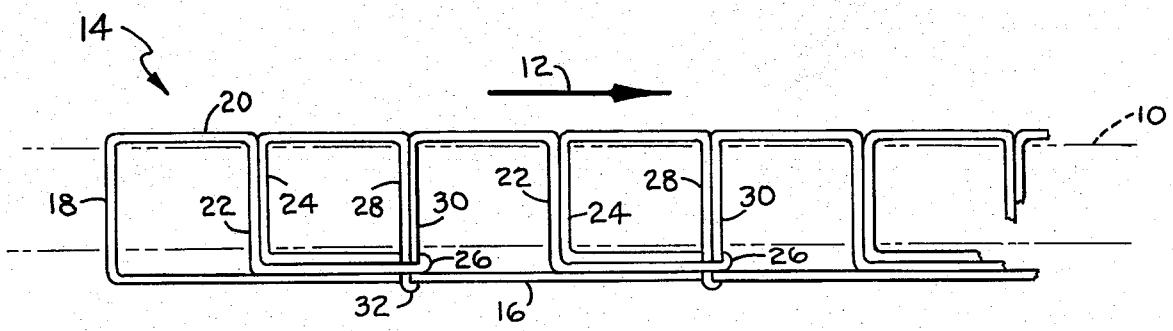

The known methods of forming a stitch are basically of two types, chain stitch and lock stitch. The single thread chain stitch is formed from one upper thread, while the double thread chain stitch utilizes an upper and a lower thread. The stitches in the single chain stitch are formed by inserting each upper needle thread loop through the preceding needle loop and retaining the loop open to enable insertion of the subsequent loop. In the double thread chain stitch, the upper needle thread loops are passed through the material and are interlaced with the loops of the under thread. Inasmuch as it is not necessary to pass a supply of thread completely through the loop in a chain stitch, it is possible to utilize a very large supply of thread. A disadvantage of the chain stitch resides in either a skipped stitch during formation or the severing of a stitch which will result in the unraveling of a number of the stitches.

The lock stitch is formed from an upper or needle thread and a lower or bobbin thread. A loop of the needle thread is passed through the material, and the entire supply of the lower thread is passed through the loop, leaving a single strand extending through the loop. The supply of lower thread is of necessity limited by the fact that it has to be passed through the needle thread loop. This creates a disadvantage in that the changing of the thread supply from time to time creates down time on the machine. However, severing of one stitch does not involve the loss by unchaining of a number of stitches.

It has been proposed to form the lock stitch from a single needle thread by dividing the thread into two parts on the first needle penetration. The first part is the upper needle thread and the second part is the lower thread. On subsequent penetrations of the needle, the lower thread is passed through the loop formed in the upper thread. The disadvantage of this stitch is period of time required to wind the lower part on the bobbin or the slow speed at which the machine must operate in order to ascertain that the under thread is in its proper position and under correct tension at all times.

SUMMARY OF THE INVENTION

The object of the invention is to provide a stitch formation and method of making it which combines the best features of both the chain stitch and lock stitch. By alternating every other stitch as a chain stitch, the time required to pass the under thread through the upper thread loop is cut in half. Also, by forming every other stitch as a lock stitch, the stitch itself can only be unchained to the next nearest lock stitch, thus preventing loss of the entire stitch formation when one stitch is severed.

At the present time the instant invention has been practiced by manually following the steps of the method and in forming the stitch formation. However, it is contemplated that mechanical means could be utilized in the future which would both follow the method disclosed and form the stitch formation of this invention. In such an event the machine would not require the down time for changing a bobbin as is necessary in two thread lock stitch machines.

In one form of the invention, it is proposed to form a short stitch formation, such as for a buttonhole, wherein the length of the thread for the under thread is a single strand having its free end located on the underside of the material.

In a second form of the invention, it is proposed to form a long stitch formation composed of a plurality of shorter stitch formations. Each of the shorter stitch formations is formed by pulling a long loop through the material on the first needle penetration. That loop has to be of sufficient length to form at least three locking stitches. As the length of each locking stitch loop is exceeded, a new loop will be formed on the next penetration for the succeeding series of stitches. In this manner any desired length can be formed from the shorter series of combination chain and lock stitches.

It is understood that the foregoing is merely an illustration of the potential uses for the stitch formation and method of the invention. For a more complete understanding of the invention and its advantages, reference should be made to the following detailed description of the preferred embodiments and to the accompanying drawings.

DESCRIPTION OF THE DRAWINGS AND PREFERRED EMBODIMENTS

Figure 2:
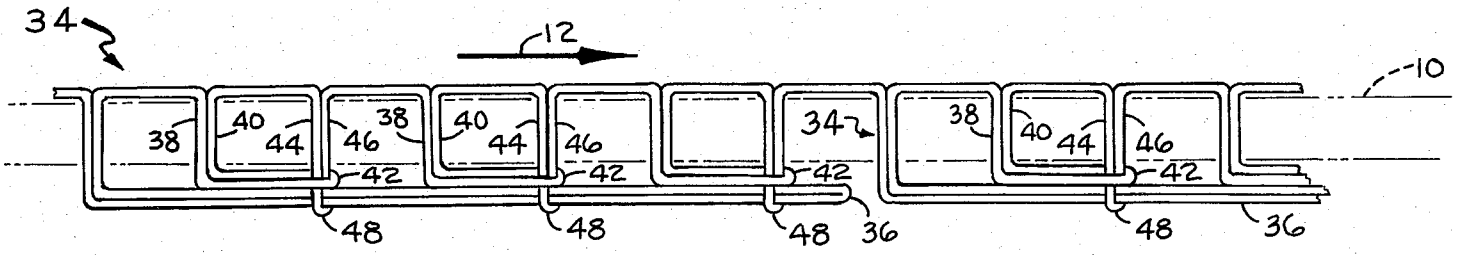

FIG. 1 shows a short form of combination chain and lock stitch in which the locking thread consists of a single strand of thread, and FIG. 2 shows a long form of combination chain and lock stitch in which the locking thread in each short series of stitches consists of a double strand of thread.

Referring now more particularly to FIG. 1, a work piece 10 is indicated by the phantom lines and the direction of stitching is indicated by the arrow 12. A single thread, indicated generally at 14, is passed through the material 10 at spaced intervals to form the stitch formation therein.

On the first passing through of a needle or the like carrying the thread, the needle or the like is stopped in the work to enable a portion of thread to be drawn through to form a lower thread portion 16 which remains on the opposite side of the material 10. The passing through of the needle can be accomplished manually in any well known manner. A single strand 18 of the thread thus extends through the material 10 and forms the first part of the stitch formation. A first loop is formed in the upper thread 20 and is passed through the material 10 at a spaced distance from the single strand 18. The loop has its two legs 22 and 24 passing through the material 10 with its bight portion 26 extending in the direction of sewing 12 for a distance equal to the spacing of the stitches. A second loop is then passed through the material 10 and its legs 28 and 30 pass through the first loop adjacent the bight portion 26. The bight portion 32 of the second loop lies closely adjacent to the underside of the material 10 and the under thread 16 is passed manually through the second loop at the bight portion 32. Thus, the first loop forms a chain stitch with the second loop, while the second loop forms a locking stitch with the under thread 16. The first and second type loops are alternately formed until the desired length of stitch formation has been attained.

In forming the stitch formations of FIG. 1, the length of the under thread may make it too cumbersome to handle if the length of the stitch formation is to be extensive. Therefore, in FIG. 2 there is illustrated an alternate form of the stitch shown in FIG. 1, which can be carried on for great lengths and which is limited only by the amount of thread in the single thread supply.

On the first stitch 34, a long loop 36 is drawn through the material 10 instead of the single strand of the previous embodiment. The loop is of a sufficient length to enable at least three locking stitches to be formed. The loop 36 is retained on the opposite side of the material during the stitch formation. A second loop, having legs 38 and 40 and a bight portion 42, is then passed through the material with the bight portion 42 extending in the direction of sewing 12. A third loop, having legs 44 and 46, is passed through the material 10 and the second loop adjacent the bight portion 42 to form a chain stitch with the second loop. The third loop has a bight portion 48 through which the first loop 36 is passed to form a locking stitch.

Alternate chain and locking stitches are then formed until the length of the first loop is exhausted. At that time a new long locking loop will be drawn through the material, and a new series of alternate chain and locking stitches can be formed. Thus any length of continuous stitch formation can be made from a series of shorter stitch formations.

It is to be understood that the invention is not limited to the embodiments shown and described, but many changes and modifications can be made without departing from the invention as defined in the appended claims.

What is claimed is:

1. A stitch formation for insertion into a work piece, said stitch formation comprising a first loop passing through the work piece and forming the first half of a chain stitch, a second loop passing spaced from said first loop and passing through the work piece and the closed end of said first loop forming with said first loop the second half of said chain stitch, a locking thread passing through the closed end of said second loop to form with said second loop a lock stitch, said chain and lock stitches being continuously alternated for the desired length of the stitch formation, said stitch formation being formed from a single continuous thread, and said locking thread comprises a single strand of thread passing through the work piece in spaced relation to the first loop in advance of the first loop and of a length equal to the desired length of stitch formation.

2. A stitch formation for insertion into a work piece, said stitch formation comprising a first loop passing through the work piece and forming the first half of a chain stitch, a second loop passing spaced from said first loop and passing through the work piece and the closed end of said first loop forming with said first loop the second half of said chain stitch, a locking thread passing through the closed end of said second loop to form with said second loop a lock stitch, said chain and lock stitches being continuously alternated for the desired length of the stitch formation, said stitch formation being formed from a single continuous thread, and said locking thread comprising a loop passing through the work piece in advance of and in spaced relation to said first loop and of a length extending through at least three locking stitches.

3. A stitch formation according to claim 2 wherein at least two continuous series containing at least three complete alternate chain and lock stitches form an elongated stitch formation.

4. A method of forming a combination chain and lock stitch from a single continuous thread supply located on one side of a work piece, said method comprising inserting the thread through the work piece from the one side thereof, drawing off a length of said thread and retaining said drawn off length on the side of said work piece opposite said thread supply, forming a first loop in the thread on the said one side of said work piece, inserting said first loop through the work piece at a point spaced from said first insertion, maintaining the bight portion of said loop in open position on the opposite side of said work piece with said bight portion extending in the direction of stitch formation, forming a second loop in the thread on the said one side of said work piece, inserting said second loop through said work piece at a point spaced from the insertion of said first loop, passing the bight portion of said second loop through the bight portion of the first loop to form a chain stitch therewith, maintaining the bight portion of said second loop in open position, passing the free end of said drawn off thread through the bight portion of said second loop to form a lock stitch therewith, and continuing to alternate said chain and lock stitches until the desired length of stitch formation has been attained.

5. A method of forming a combination chain and lock stitch from a single continuous thread supply located on one side of a work piece, said method comprising forming a first loop in said thread, inserting said loop through the work piece from the one side thereof, drawing a substantial length of said loop on the opposite side of said work piece, forming a second loop in the thread on the said one side of said work piece, inserting said second loop through the work piece at a point spaced from said first insertion, maintaining the bight portion of said second loop in open position on the opposite side of said work piece with said bight portion extending in the direction of stitch formation, forming a third loop in the thread on the said one side of said work piece, inserting said third loop through said work piece at a point spaced from the insertion of said second loop, passing the bight portion of said third loop through the bight portion of the second loop to form a chain stitch therewith, maintaining the bight portion of said third loop in open position, passing the bight portion of said first loop through the bight portion of said third loop to form a lock stitch therewith, and continuing to alternate forming said chain and lock stitches until the length of the first loop is exhausted.

6. The method of forming a combination chain and lock stitch of claim 5 wherein after exhaustion of the length of the first loop a fourth loop similar to the first loop is formed and passed through the work piece, said fourth loop being a continuous extension of the last formed third type of loop, and repeating the alternate forming of chain and lock stitches utilizing said fourth loop as the locking thread.

7. The method of forming the combination chain and lock stitch of claim 6 wherein, a locking type loop is formed in said thread each time the length of the previous locking loop is exhausted, and a new series of alternate chain and lock stitches is formed, the number of such series equaling the desired length of stitch formation.

* * * * *